US006585883B1

(12) United States Patent
Kelemen et al.

(10) Patent No.: US 6,585,883 B1
(45) Date of Patent: Jul. 1, 2003

(54) MITIGATION AND GASIFICATION OF COKE DEPOSITS

(75) Inventors: Simon Robert Kelemen, Annandale, NJ (US); Michael Siskin, Randolph, NJ (US); Glen Edward Phillips, Goldvein, VA (US); Nicholas Charles Nahas, Chatham, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/685,360

(22) Filed: Oct. 10, 2000

Related U.S. Application Data

(63) Continuation-in-part of application No. 09/438,457, filed on Nov. 12, 1999, now abandoned.

(51) Int. Cl.[7] ..... C10G 9/16

(52) U.S. Cl. ..... 208/48 AA; 208/48 R; 585/950

(58) Field of Search ..... 208/48 R, 48 AA; 585/950

(56) References Cited

U.S. PATENT DOCUMENTS

| | | | | | |
|---|---|---|---|---|---|
| 2,064,708 | A | | 12/1936 | Wilson | 208/48 R |
| 2,859,168 | A | | 11/1958 | Downing et al. | 208/48 R |
| 3,365,387 | A | | 1/1968 | Cahn et al. | 208/48 |
| 3,376,213 | A | | 4/1968 | Harper | 208/48 R |
| 3,617,481 | A | * | 11/1971 | Voorhies, Jr. et al. | 208/50 |
| 3,641,190 | A | | 2/1972 | Kivlen et al. | 260/683 |
| 3,803,023 | A | * | 4/1974 | Hamner | 208/46 |
| 3,843,744 | A | | 10/1974 | Kramer et al. | 585/539 |
| 3,964,976 | A | | 6/1976 | Pettrey, Jr. et al. | 201/2 |
| 4,022,639 | A | | 5/1977 | Ueki | 134/2 |
| 4,043,899 | A | | 8/1977 | Anderson et al. | 208/161 |
| 4,060,478 | A | * | 11/1977 | Lang | 208/8 |
| 4,269,696 | A | | 5/1981 | Metrailer | 208/120 |
| 4,345,989 | A | * | 8/1982 | Vernon et al. | 208/10 |
| 4,376,694 | A | | 3/1983 | Lohr et al. | 208/48 R |
| 4,400,182 | A | | 8/1983 | Davies et al. | 48/214 A |
| 4,405,440 | A | | 9/1983 | Gwyn | 208/48 Q |
| 4,454,022 | A | | 6/1984 | Shoji et al. | 208/48 R |
| 4,583,993 | A | | 4/1986 | Chen | 48/197 R |
| 4,816,136 | A | | 3/1989 | Allan et al. | 208/127 |
| 4,849,025 | A | | 7/1989 | Bain et al. | 134/22.1 |
| 5,284,574 | A | * | 2/1994 | Chen et al. | 208/127 |
| 5,358,626 | A | * | 10/1994 | Gandman et al. | 208/48 R |
| 5,466,361 | A | * | 11/1995 | Heck et al. | 208/131 |
| 5,472,596 | A | | 12/1995 | Kerby et al. | 208/127 |
| 5,567,305 | A | * | 10/1996 | Jo | 208/48 R |
| 5,747,401 | A | | 5/1998 | Cuif | 501/103 |
| 5,752,990 | A | * | 5/1998 | Siskin et al. | 44/418 |
| 5,820,747 | A | * | 10/1998 | Lenglet et al. | 208/130 |
| 5,972,206 | A | * | 10/1999 | Lenglet et al. | 208/130 |
| 5,976,352 | A | | 11/1999 | Busson et al. | 208/75 |
| 6,228,253 | B1 | * | 5/2001 | Gandman | 208/48 AA |

FOREIGN PATENT DOCUMENTS

| | | | |
|---|---|---|---|
| EP | 0643122 A2 | 3/1995 | C10G/11/18 |

OTHER PUBLICATIONS

Claudio Badini et al, "Suitability of some promising soot combustion catalysts for application in diesel exhaust treatment", Applied Catalysis B: Environmental 18 (1998) 137–150 No month.

John P. A. Neeft et al, "Catalytic oxidation of carbon black—I. Activity of catalysts and classification of oxidation profiles", Fuel, 1998, vol. 77, No. 3, pp. 111–119 No date.

"Suitability of Some Promising Soot Combustion Catalysts for Application in Diesel Exhaust Treatment"; Claudio Badini, et.al., Torino, Italy; Elsevier, Applied Catalysis B: Environmental 18 (1998), pp. 137–150, No month.

"Catalytic Oxidation of Carbon Black—I. Activity of Catalysts and Classification of Oxidation Profiles", John P.A. Neeft, et.al., Industrial Catalysis, Department of Chemical Egineering Delft University of Technology, The Netherlands (Jul. 7, 1997), Elsevier, PII: S0016–2361(97)00187–7; Fuel vol. 77, No. 3, pp. 111–119, 1998.

* cited by examiner

*Primary Examiner*—Nadine G. Norton
(74) *Attorney, Agent, or Firm*—Estelle C. Bakun; George B. Georgellis

(57) ABSTRACT

A method for removing or reducing coke deposits in a refinery reactor unit utilizing a reactant gas, preferably steam, and catalyst.

27 Claims, 2 Drawing Sheets

MITIGATION AND GASIFICATION OF COKE DEPOSITS

This application is a Continuation-in-Part of U.S. Ser. No. 09/438,457 filed Nov. 12, 1999, now abandoned.

FIELD OF THE INVENTION

A preferred embodiment of the invention is directed to a catalytic gasification method for removing or reducing coke deposits in cyclones of fluid cokers and/or on accompanying surfaces such as stripper sheds.

BACKGROUND OF THE INVENTION

Fluidized bed coking (fluid coking) is a petroleum refining process in which mixtures of heavy petroleum fractions, typically the non-distillable residue (resid) from fractionation, are converted to lighter, more useful products by thermal decomposition (coking) at elevated reaction temperatures, typically about 900to 1100° F. (about 480to 590° C.). A large vessel of coke particles maintained at the reaction temperature is fluidized with steam. The feed is heated to a pumpable temperature, mixed with atomizing steam, and fed through a plurality of feed nozzles to the fluidized bed reactor. The light hydrocarbon products of the coking reaction are vaporized, mixed with the fluidizing steam and pass upwardly through the fluidized bed into a dilute phase zone above the dense fluidized bed of coke particles. The transition between the dense bed (dense phase zone) and dilute phase, where product vapor is substantially separated from solid particles, is hereinafter referred to as the phase transition zone. The remainder of the feed liquid coats the coke particles and subsequently decomposes into layers of solid coke and lighter products which evolve as gas or vaporized liquid. The solid coke consists mainly of carbon with lesser amounts of hydrogen, sulfur, nitrogen, and traces of vanadium, nickel, iron, and other elements. The fluidized coke is circulated through a burner, where part of the coke is burned with air to raise its temperature from about 900° F. to about 1300° F. (about 480to 704° C.), and back to the fluidized bed reaction zone.

The mixture of vaporized hydrocarbon products and steam continues to flow upwardly through the dilute phase at superficial velocities of about 3to 6feet per second (about 1 to 2 meters per second), entraining some fine solid particles. Most of the entrained solids are separated from the gas phase by centrifugal force in one or more cyclone separators, and are returned to the dense fluidized bed by gravity. The gas phase undergoes pressure drop and cooling as it passes through the cyclone separators, primarily at the inlet and outlet passages where the velocity is increased. The cooling which accompanies the pressure decrease causes condensation of some liquid which deposits on surfaces of the cyclone inlet and outlet. Because the temperature of the liquid so condensed and deposited is higher than about 900° F. (about 480° C.), coking reactions occur there, leaving solid deposits of coke. Coke deposits also form on the reactor stripper sheds, and other surfaces of the fluid coker reactor.

The mixture of steam and hydrocarbon vapor is subsequently discharged from the cyclone outlet and quenched to about 750° F. (about 400° C.) by contact with downflowing liquid in a scrubber vessel section of the fluid coker equipped with internal sheds to facilitate contacting. A pumparound loop circulates condensed liquid to an external cooling means and back to the top row of scrubber sheds to provide cooling for the quench and condensation of the heaviest fraction of the liquid product. This heavy fraction is typically recycled to extinction by feeding back to the fluidized bed reaction zone, but may be present for several hours in the pool at the bottom of the scrubber vessel and the pumparound loop, allowing time for coke to form and deposit on shed surfaces because of the elevated temperatures.

Feed is injected through nozzles with atomizing steam into the fluidized bed reactor. The feed components not immediately vaporized coat the coke particles and are subsequently decomposed into layers of solid coke and lighter products which evolve as gas or vaporized liquids. During this conversion process some coke particles may become unevenly or too heavily coated with feed and during collision with other coke particles stick together. These agglomerated, now heavier, coke particles may not be efficiently fluidized by the steam injected into the bottom of stripper section and are subsequently carried under from the reactor section to the stripper section where they adhere to and build up on the top rows of sheds in the stripper section. Build up of deposits on the stripper sheds can become so severe due to overlapping of the deposits on adjacent sheds as to restrict fluidization of the coke in the reactor section above and eventually shut the unit down.

Fouling of cyclone outlets and of stripper sheds in a Fluid Coker results in decreased throughput and eventual shutdown of the unit. Both effects can be very costly to a refinery. The deposits are sometimes removed from the outlet of the cyclone with metal rods and water jets at high pressure to mechanically clear the cyclone outlet area and to keep the unit running. The effectiveness of this approach is temporary and unpredictable. Chunks of coke may fall back into the cyclone body and interfere with cyclone operation. The coke deposits must also be removed from the reactor stripper sheds and other areas of the fluid coker that become fouled.

What is needed in the art is an efficient, predictable, and effective way to remove or reduce such detrimental coke deposits in fluid coker cyclones and accompanying surfaces to avoid throughput reductions and expensive shutdowns.

SUMMARY OF THE INVENTION

A preferred embodiment of the invention is directed to catalytic removal or reduction of coke deposits formed in a fluid coker unit during operation of said unit. Though the method is particularly useful for fluid coker units, it can be broadly applied to any units in which coke deposition occurs such as Fluid Catalytic Cracking Units (FCCUs). All that is necessary is that the coke deposits be accessible to reactant gas and that the metallurgy of the system be compatible with the catalytic gasification temperatures.

An embodiment of the invention is directed to a method for removing or reducing coke deposits in a refinery reactor unit, said method comprising catalytically gasifying said coke deposits by (a) optionally ceasing hydrocarbon feed to said unit, (b) coating or impregnating said coke deposits with a catalyst effective in converting coke to a gaseous product comprising hydrogen and carbon monoxide, (c) contacting said coke deposits with a reactant gas comprising substantially steam, in the substantial absence of oxygen, at a temperature of at least about 500° C. for a time sufficient to convert a portion of said coke deposits to a gaseous product comprising substantially carbon monoxide and hydrogen.

In a fluidized refinery unit, fluidization of the coke may be maintained during said catalytic gasification. It may be necessary to temporarily reduce the flow of feed and/or fluidizing steam. One skilled in the art can readily determine how much and if the flow should be reduced based on the unit's operating conditions. In the instant process, reactant gas comprising substantially steam may be added in addition to the steam utilized to fluidize the unit. The fluidizing steam may be incapable of reducing or removing coke deposits unless it is at a sufficiently high temperature. If the temperature of the fluidizing steam can be increased to the temperatures (at least about 500° C.) described herein, then the fluidizing steam may be used as the gasifying steam.

As used herein comprising substantially steam means at least 99 volume % steam. In the substantial absence of oxygen means less than 1 volume % oxygen. Comprising substantially carbon monoxide and hydrogen means the gaseous product excluding steam, carbon dioxide and oxygen from combustion, and light hydrocarbon products-cracked off the coke will contain at least 90 volume % of carbon monoxide and hydrogen combined.

DETAILED DESCRIPTION OF THE INVENTION

Figure 1:
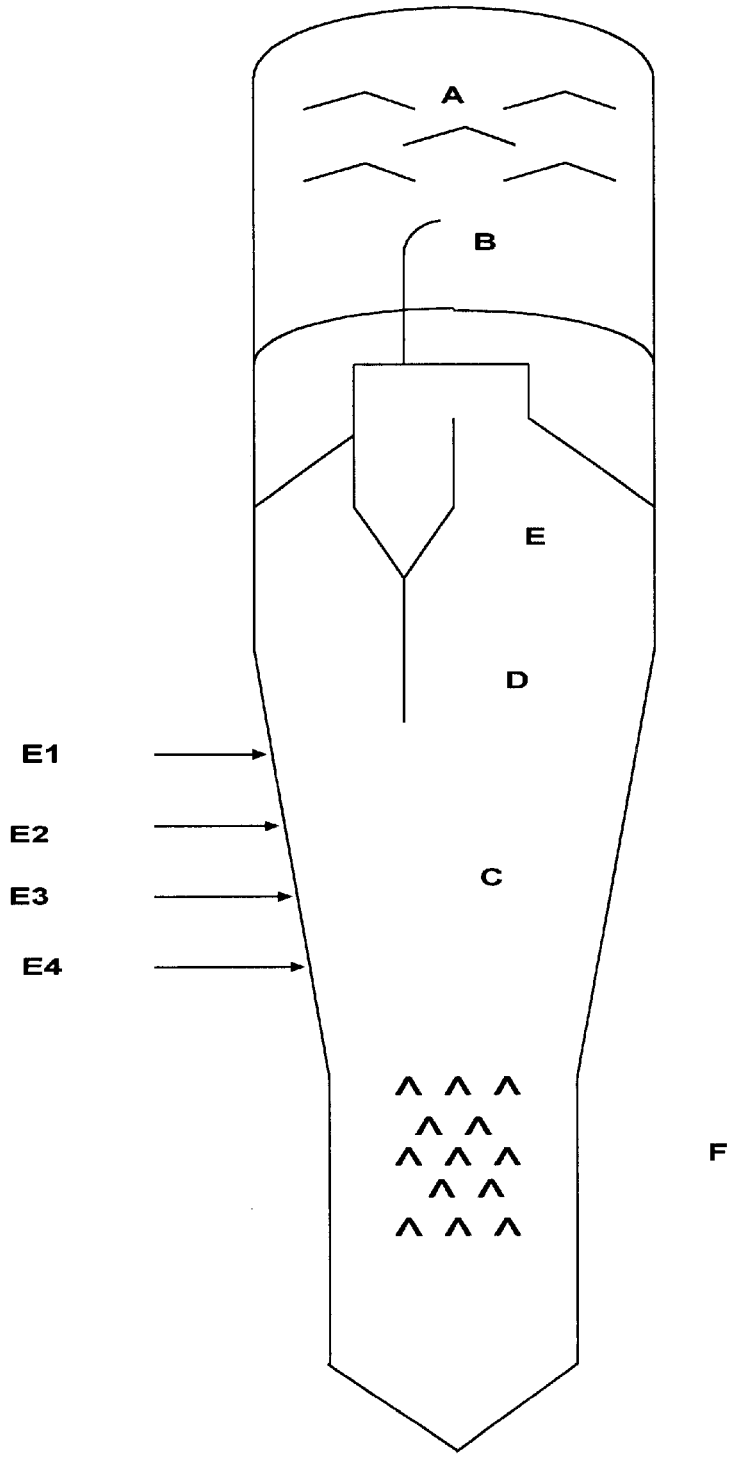
FIG. 1 depicts a typical fluid coking unit. A are scrubber sheds, B the cyclone outlet, C, D, and E are the dense phase reaction zone, phase transition zone, and dilute phase reaction zone, respectively. $E_1$, $E_2$, $E_3$, $E_4$ are feed injection ports, and F are stripper sheds.
Figure 2:
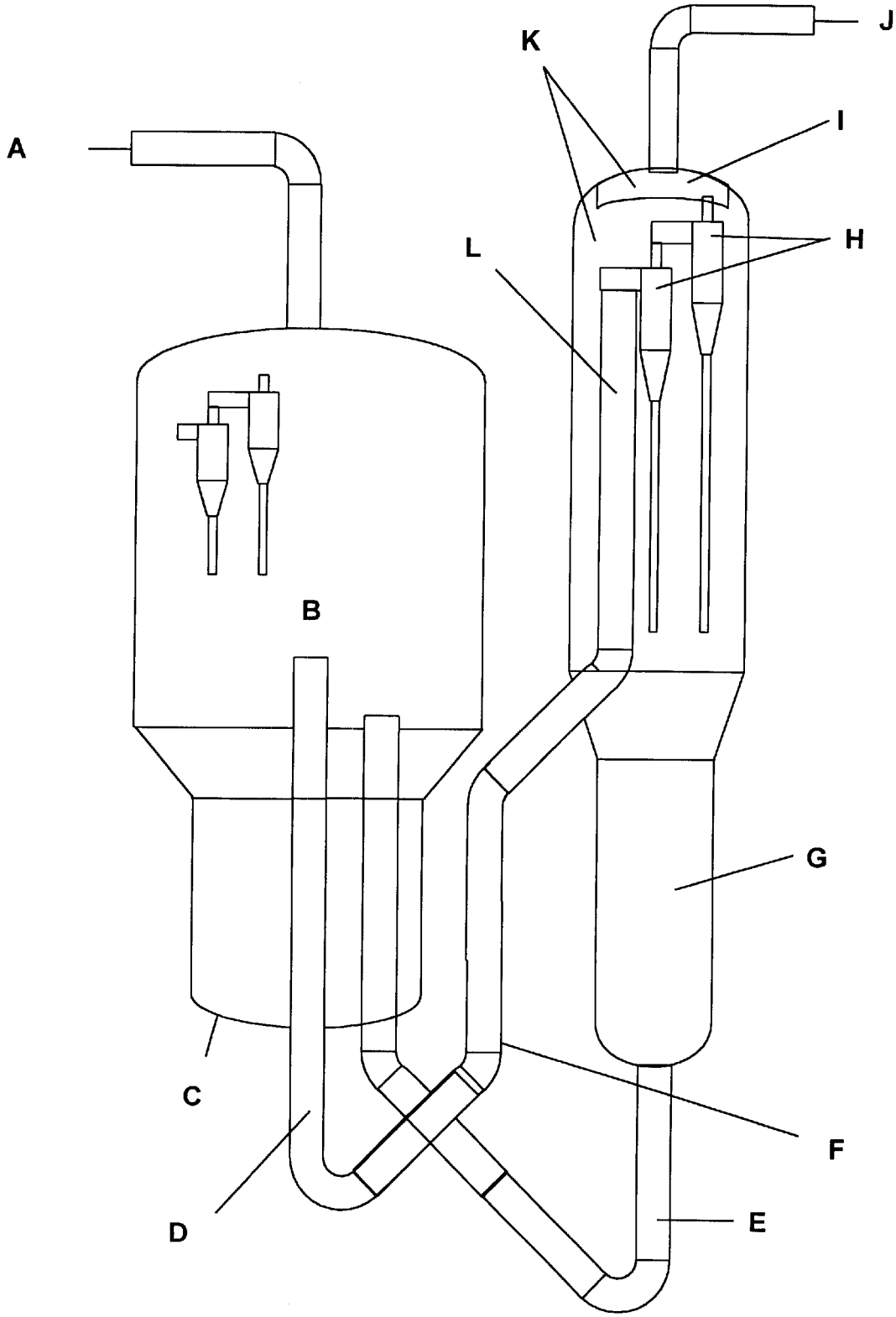
FIG. 2 depicts a typical FCCU. A=flue gas outlet, B=regenerator, C=air injection, D=regenerated catalyst standpipe, E=spent catalyst standpipe, F=feed, G=stripper, H=cyclone separators, I=plenum, J=Product Vapor outlet, K=dilute phase zone, and L=dense phase reaction zone.

During operation of a fluid coker, coke is laid down in several areas of the cyclone and also on the stripper and scrubber sheds. Areas such as the cyclone outlet and stripper and scrubber sheds are of particular concern since the deposited coke on the stripper sheds can restrict flow causing loss of fluidization in the reactor section and system shutdown. Likewise the cyclone outlet can become plugged also necessitating a shutdown.

The method affords a way of reducing the levels of deposited coke in all areas of the unit accessible to reactant gas and catalyst. Catalyst may be introduced as an aqueous or hydrocarbon solution. Upon evaporation of the water or hydrocarbon, catalyst is deposited on the coke or impregnated therein. Catalyst solutions can be introduced through injection ports, lancing equipment, nozzles, etc. For cyclones that are equipped with injection ports, or a means for carrying the reactant gas to areas having coke deposits, the reactant gas can merely be injected into the ports or means for carrying the reactant gas to the coke deposits at the desired temperature to achieve catalytic removal of the coke deposits. Alternatively, the reactant gas can be injected by inserting a tube into the cyclone snout and introducing reactant gas through the tube. The gasified coke, which has been converted to a gaseous product comprising substantially carbon monoxide and hydrogen, is then removed via a gas sweep. Any sweep gas that does not adversely impact the fluid coker process can be used to sweep away the gasified coke products. Preferably, steam will be utilized. Such gases may include nitrogen, argon or other inert gases, carbon monoxide, natural gas and mixtures thereof, and are readily selected by the skilled artisan.

An embodiment of the method offers a cost effective and efficient way to reduce the coke deposits that form in fluid cokers to facilitate longer run times and to maintain throughput. Effective reduction of coke deposits in all areas of the coker where reactant gas can be injected and contact the coke deposits, including the cyclone body, cyclone inlet, gas outlet tube, stripper sheds, scrubber sheds and areas where blockages occur, is achieved. Areas such as the cyclone outlet and reactor stripper sheds experience significant coke reduction. The coke deposits can be reduced or removed from any surfaces of the fluid coker unit utilizing the catalytic gasification method described herein. All that is necessary is that the reactant gas is able to contact the deposits having catalyst coated thereon or impregnated therein, and that the temperature of the reactant gas be compatible with the metallurgy of the unit and unit components being treated. One skilled in the art will readily recognize that compatibility when reducing coke as opposed to removing coke may accommodate different temperature reactant gas during gasification. This is because during coke deposit reduction, while the surface layers of the coke are being gasified, the underlying layers act as insulators of the metal surfaces being treated. Therefore, if only the outer layers of the coke deposits are being removed, it may be possible to use reactant gas of a higher temperature than when gasifying the coke deposits completely. One skilled in the art can readily determine the temperatures of reactant gas that will be compatible with the metallurgy of the surfaces being treated for coke deposit removal and which will accomplish the desired coke deposit gasification. All that is necessary is that the reactant gas temperature be sufficient to enable the catalytic gasification reaction to occur at a temperature compatible with the metallurgy of the system.

Prior to conducting the catalytic removal or reduction of the coke deposits, the deposits will be coated or impregnated with a catalyst effective for catalyzing coke removal or reduction. Such catalysts include alkoxylated and non-alkoxylated cerium, titanium and zirconium oxides; lead, cobalt, vanadium and silver oxides; alkali and alkaline earth metal carbonates and hydroxides; group VIII transition metal oxides; mixed cesium and vanadium oxide-potassium chloride ($CsVO_3$+KCl), potassium vanadium oxide-potassium chloride (KVO+KCl), Cu—K—V—Cl catalysts, and mixtures thereof. As used herein coke reduction means a decrease in the amount of coke present and is not meant to imply that the coke is chemically reduced.

The concentration of catalyst used depends upon the surface area of the coke and, therefore, can range from 0.01 to 100 wt %; preferably, from about 0.01 to 10 wt %; more preferably, from about 0.01 to 5 wt % and; most preferably, from about 0.01 to 1 wt % based on the amount of coke. Additional surface area will be created as the catalytic removal or reduction of the coke progresses.

The catalytic gasification taught herein simply involves injecting reactant gas into the unit such that it contacts the coke deposits at temperatures of at least about 500° C. to about 700° C., preferably at least about 510° C. to 600° C. and most preferably at least about 530° C. to 600° C. At such temperatures, the steam readily converts the coke deposits to carbon monoxide, and hydrogen. Small amounts of carbon dioxide and water may likewise be produced via a combustion mechanism if any oxygen is present during the reaction. Furthermore, at such low temperatures, the catalytic removal or reduction method should be compatible with the metallurgy of any type of refinery unit. One skilled in the art will recognize that the surface of the coke deposits must be heated to the temperatures noted above for the gasification to occur. The rate at which the gasification occurs will depend on the density and surface area of the coke and the number of active sites. However, the coke reduction, via gasification can be continued until such time as the coke deposits have been reduced to a level which allows the unit and cyclone to perform at a desired level. One skilled in the art will recognize that this does not mean that coke deposits have to be removed down to the bare metal surface. Preferably, the gasification will be continued until the throughput of the cyclone is restored to its original state and the coke deposits on the upper rows of stripper sheds have been gasified. During the catalytic removal or reduction, it is preferable to use atmospheric pressure. However, pressure will depend upon the ease of operation, e.g., steam pressure required to maintain fluidization, deposit location, etc.

The reactant gas used herein is substantially comprised of steam, but may contain small amounts of oxygen, air, carbon dioxide or an admixture thereof. The use of traces of oxygen provides localized heat to the endothermic gasification process and consumes part of the coke thereby speeding up the gasification. The amount of oxygen will range from 0 to 1 volume %, preferably less than 1 volume % and most preferably the reaction will be run in the absence of oxygen. Care must be exercised to avoid too rapid removal of coke deposits and development of hot spots or a runaway reaction, especially when oxygen is present. The oxygen-containing gas may be selected from air admixed with other inert gases. By inert is meant a gas inert in the refinery reactor such as nitrogen.

One skilled in the art will recognize that the scrubber, which scrubs the hydrocarbon gases exiting the cyclone, may be drained of hydrocarbon liquid used to quench the fluid coker products. This may be desirable because any remaining hydrocarbon liquid might interfere with reactant gas contacting the coke-containing catalyst.

It may be preferable to drain fluid coke from the unit prior to gasifying coke on the stripper sheds.

Preferably, in utilizing the instant invention, the gasification will be conducted for times and at temperatures as necessary to maintain or restore the throughput of the cyclone. Beneficially, the reactant gas can be injected for short periods of about 2–4 hours every two to four months. The reactant gas may also be injected for longer or shorter periods depending on the level of coke deposited and the throughput of the cyclone desired. Typically, atmospheric pressure will be utilized. However, no particular pressure is required. The gasification may be conducted while fluidization, circulation, pressure and temperature are maintained at the normal operating conditions. If desired, however, the coker operations can be ceased while the gasification is being conducted.

In existing units where coke deposits are typically lanced with water jets, the reactant gas for gasification can be injected through the lance ports. Since existing units are also equipped with steam ports for fluidization of the bed, the existing ports can be utilized with reactant gas of adequate temperature as described herein to perform the gasification. Alternatively, new ports can be added to existing units. For newly constructed units, reactant gas ports can be designed into the units such that reactant gas can be injected in contact with surfaces that typically experience coke deposition, particularly cyclones and reactor stripper sheds. In addition, the metallurgy of newly designed units can be chosen to accommodate higher temperature reactant gas.

Desirably, 90% of unrestricted pressure drop will be obtained. The skilled practitioner can readily determine when enough coke has been gasified to enable the unit to operate at a desirable level.

The following examples are meant to be illustrative and not limiting in any way.

EXAMPLE 1

A sample was prepared by mixing equal amounts of $K_2CO_3$ and a fluid coker unit stripper shed deposit. The sample was placed into the sample holder of a Thermogravimetric Analysis (TGA) apparatus. The sample temperature was raised from room temperature at a heating rate of 10° C. per minute in a flow of nitrogen at 1 atm of pressure up to the reaction temperatures noted in Table 1. The flow of gas is switched to air at 1 atm of pressure upon reaching the reaction temperatures. The sample temperature was held constant and weight loss recorded as a function of time. As illustrated in the Table, at 500° C. approximately 44 wt % of the fluid coker deposit sample was lost after 5 minutes. The same example was then repeated using steam and steam containing 1 volume % oxygen.

TABLE 1

| Temperature | Time | Weight Percent Loss of Fluid Coker Deposit Without Catalyst | Weight Percent Loss of Fluid Coker Deposit With Catalyst | |
|---|---|---|---|---|
| 500° C. | 5 Minutes | 4 | 44 | Air |
| 450° C. | 25 Minutes | 3 | 34 | Air |
| 400° C. | 100 Minutes | 4 | 31 | Air |
| 500° C. | 5 Minutes | 4 | 29 | $H_2O$ |
| 520° C. | 5 Minutes | 4 | 36 | $H_2O$ + 1% $O_2$ |

As can be seen from the table, steam in conjunction with catalyst and steam containing minor amounts of oxygen in conjunction with catalyst achieves coke gasification. This affords an advantage over air or oxygen combustion of coke deposits since the presence of additional amounts of oxygen may cause a runaway reaction and valuable hydrogen and carbon monoxide are produced as products instead of carbon dioxide and water.

What is claimed is:

1. A method for removing or reducing coke deposits in a reactor unit selected from the group consisting of FCC, fluid coking, FLEXICOKING, and delayed coking units, said method comprising catalytically gasifying said coke deposits by (a) optionally ceasing hydrocarbon feed to said unit, (b) in the substantial absence of a reactant gas in said reactor treating said coke deposits with a catalyst as a solution to coat and/or impregnate said coke deposits with said catalyst being effective in converting coke to a gaseous product comprising hydrogen and carbon monoxide, (c) contacting said coke deposits with said reactant gas comprising substantially steam, in the substantial absence of oxygen, at a temperature of from about 500° C. to about 700° C. for a time sufficient to convert a portion of said coke deposits to a gaseous product comprising substantially carbon monoxide and hydrogen.

2. The method of claim 1 wherein said reactant gas is injected into said reactor at a temperature of from about 510° C. to about 600° C.

3. The method of claim 1 wherein said reactant gas comprises less than 1 volume % oxygen.

4. The method of claim 1 wherein said method is conducted in the absence of oxygen.

5. The method of claim 1 wherein said reactant gas is at least 99 volume % steam.

6. The method of claim 1 wherein the refinery unit is fluidized during said catalytic removal or reduction.

7. The method of claim 1 wherein the catalytic removal or reduction is conducted until said-unit is restored to 90% of its unrestricted pressure drop.

8. The method of claim 1 wherein said catalytic removal or reduction is continued until the throughput of said refinery unit is restored to its original throughput.

9. The method of claim 1 wherein said catalyst is selected from the group consisting of alkoxylated and non-alkoxylated cerium, titanium and zirconium oxides; lead, cobalt, vanadium and silver oxides; alkali and alkaline earth metal carbonates and hydroxides; group VIII transition metal oxides; mixed cesium and vanadium oxide-potassium chloride ($CsVO_3$+KCl), potassium vanadium oxide-potassium chloride (KVO+KCl), Cu—K—V—Cl catalysts, and mixtures thereof.

10. The method of claim 1 wherein said refinery unit is a fluid catalytic cracking unit (FCCU).

11. The method of claim 1 wherein said refinery unit is a fluid coker.

12. The method of claim 1 wherein said refinery unit is a FLEXICOKER.

13. The method of claim 1, wherein said catalyst is potassium carbonate.

14. The method of claim 1, wherein said catalyst is added in an amount of from about 0.01 to about 10 wt % based on the amount of said coke deposits.

15. A method for reducing coke deposits in a reactor unit selected from the group consisting of FCC, fluid coking, FLEXICOKING, and delayed coking units, said method comprising:

ceasing hydrocarbon feed to said unit, in the substantial absence of a reactant gas in said reactor treating said coke deposits with an effective amount of a decoking catalyst as a solution to coat and/or impregnate said coke deposits with said decoking catalyst, contacting said treated coke deposits with said reactant gas comprising substantially steam at an effective temperature and for a time sufficient for an effective reduction of said treated coke deposits to a gaseous product comprising substantially carbon monoxide and hydrogen.

16. The method of claim 15, wherein said effective temperature is from about 500° C. to about 700° C.

17. The method of claim 15, where in said effective temperature is from about 510° C. to about 600° C.

18. The method of claim 15, wherein said reactant gas comprises less than 1 volume % oxygen.

19. The method of claim 15, wherein said reactant gas is free of oxygen.

20. The method of claim 15, wherein said reactant gas is at least 99 volume % steam.

21. The method of claim 15, wherein the reactor is a fluidized bed reactor and is fluidized during said catalytic removal or reduction.

22. The method of claim 15, wherein said catalytic reduction is continued until said reactor is restored to 90% of its unrestricted pressure drop.

23. The method of claim 15, wherein said catalytic reduction is continued until the throughput of said refinery unit is restored to its original throughput.

24. The method of claim 15, wherein said catalyst is selected from the group consisting of alkoxylated and non-alkoxylated cerium, titanium and zirconium oxides; lead, cobalt, vanadium and silver oxides; alkali and alkaline earth metal carbonates and hydroxides; group VIII transition metal oxides; mixed cesium and vanadium oxide-potassium chloride ($CsVO_3$+KCl), potassium vanadium oxide-potassium chloride (KVO+KCl), Cu—K—V—Cl catalysts, and mixtures thereof.

25. The method of claim 15, wherein said refinery unit is selected from the group consisting of fluid catalytic cracking units, fluid cokers, and FLEXICOKER reactors.

26. The method of claim 15, wherein said catalyst is potassium carbonate.

27. The method of claim 15, wherein said catalyst is added in an amount of from about 0.01 to about 10 wt % based on the amount of said coke deposits.

* * * * *